US009708812B2

(12) United States Patent
Jeske

(10) Patent No.: US 9,708,812 B2
(45) Date of Patent: Jul. 18, 2017

(54) POUR STOP ANCHOR APPARATUS AND SYSTEM

(71) Applicant: Stewart P. Jeske, Kansas City, MO (US)

(72) Inventor: Stewart P. Jeske, Kansas City, MO (US)

( * ) Notice: Subject to any disclaimer, the term of this patent is extended or adjusted under 35 U.S.C. 154(b) by 13 days.

(21) Appl. No.: 14/827,612

(22) Filed: Aug. 17, 2015

(65) Prior Publication Data

US 2017/0051498 A1 Feb. 23, 2017

(51) Int. Cl.

| | |
|---|---|
| ***E04B 1/38*** | (2006.01) |
| ***E04C 5/00*** | (2006.01) |
| ***E04B 2/96*** | (2006.01) |
| *E04B 5/32* | (2006.01) |
| *E04B 1/41* | (2006.01) |
| *E04B 5/38* | (2006.01) |
| *E04B 2/88* | (2006.01) |
| *E04B 5/17* | (2006.01) |

(52) U.S. Cl.

CPC *E04B 2/96* (2013.01); *E04B 1/40* (2013.01); *E04B 1/41* (2013.01); *E04B 1/4107* (2013.01); *E04B 2/88* (2013.01); *E04B 5/38* (2013.01); *E04B 2005/173* (2013.01); *E04B 2005/176* (2013.01); *E04B 2005/322* (2013.01); *E04B 2005/324* (2013.01)

(58) Field of Classification Search

CPC ..... E04B 1/40; E04B 2/88; E04B 1/41; E04B 1/4107; E04B 2/96; E04B 2005/322; E04B 2005/324; E04B 5/38

USPC ..... 52/236.1, 712, 704, 698, 235, 295, 52/506.05, 242, 293.1, 298

See application file for complete search history.

(56) References Cited

U.S. PATENT DOCUMENTS

| | | | | |
|---|---|---|---|---|
| 3,968,608 | A * | 7/1976 | Swango | E04B 2/96 52/127.12 |
| 4,350,318 | A | 9/1982 | Gallis | |
| 5,720,571 | A | 2/1998 | Frobosilo et al. | |
| 5,833,417 | A * | 11/1998 | Sargent | F16B 37/046 248/58 |
| 6,170,714 | B1 * | 1/2001 | Lesage | A61C 9/0026 222/326 |
| 7,104,024 | B1 | 9/2006 | diGirolamo et al. | |
| 7,472,521 | B2 * | 1/2009 | Bilge | E04F 13/0814 52/235 |
| 7,478,508 | B2 | 1/2009 | Peterson | |
| 7,562,509 | B2 * | 7/2009 | Ness | E04F 13/0889 52/235 |
| 7,654,057 | B2 * | 2/2010 | Zambelli | E04B 1/4107 411/82 |
| 8,365,484 | B2 | 2/2013 | Foley | |
| 8,453,394 | B2 * | 6/2013 | Kobayashi | F24J 2/5245 126/704 |
| 9,109,368 | B2 * | 8/2015 | MacKenzie | E04F 13/0803 |

(Continued)

*Primary Examiner* — Chi Q Nguyen

(74) *Attorney, Agent, or Firm* — Lathrop & Gage L.L.P.

(57) ABSTRACT

Apparatus are provided for a curtain wall anchor system. The curtain wall anchor assembly may include various anchor configurations. Each anchor embodiment is intended to reduce labor time and costs and eliminate extraneous steps in the construction process involving curtain walls. Each possible anchor assembly also features an optional component of attaching a concrete anchor for optimizing load paths and solving issues of bending in traditional edge angle pour stops.

18 Claims, 4 Drawing Sheets

(56) References Cited

U.S. PATENT DOCUMENTS

| | | | | |
|---|---|---|---|---|
| 9,416,529 | B1 * | 8/2016 | Jeske | E04B 1/41 |
| 2008/0134594 | A1 * | 6/2008 | Ness | E04F 13/0889 52/200 |
| 2008/0178556 | A1 * | 7/2008 | Meeks | E04C 5/18 52/700 |
| 2008/0222981 | A1 | 9/2008 | De Gobbi | |
| 2014/0250825 | A1 * | 9/2014 | Richardson | E04B 1/4107 52/710 |
| 2016/0138261 | A1 * | 5/2016 | Zhang | E04B 1/40 52/831 |

* cited by examiner

POUR STOP ANCHOR APPARATUS AND SYSTEM

TECHNICAL FIELD

The present disclosure relates to an apparatus and system for providing for some adjustability for installation of curtain walls and for transferring the loads associated with the curtain walls to structural elements of the buildings. The present disclosure eliminates industry problems associated with wavy edge of slab pour stops constructed of bent plates and reduces considerably or eliminates the significant coordination between the construction trades thereby reducing installation costs.

BACKGROUND

Curtain walls are the outer covering of a building in which the outer walls are non-structural, and merely keep the weather out and occupants of the building in the building. A curtain wall does not carry any dead load weight from the building other than its own dead load. In this context a dead load, or also commonly referred to as a static load, includes loads that are relatively constant over time, including the weight of the structure itself, and immovable features such as walls, plasterboard or carpet. Curtain walls are designed to resist air and water infiltration, sway induced by wind and seismic forces acting on the building and its own static load weight forces. Exterior wind loads combined with the curtain wall's own weight are transferred to the building through, for example, anchors at specific points of attachment. Curtain walls may be attached to anchors via different methods. Typical curtain wall assemblies include structural members called mullions which separate and secure the curtain wall panels. The mullions are secured to the building via curtain wall anchors. Curtain wall anchors are the connection means between the curtain wall mullions, to the building structure.

Typical building construction techniques with steel supported concrete floor slabs employ a bent steel plate fixed to spandrel beams as pour stops for concrete. The bent plate pour stops may also be referred to as edge angles. Considerable time is required at a steel fabricator to bend all of the plate to install as pour stops. The bent plate pour stops are then taken to the job site, positioned, and welded on top of the spandrel beams. Bent plates often provide a wavy edge of the slab with significant deviation of the actual edge from planed location. The deviation creates difficulties in attachment of a curtain wall while trying to maintain a controlled planar surface in the outer surface of the curtain wall. Additionally, the curtain wall is typically attached to the bent plate pour stop via clip angles welded to the pour stop or supporting beam. This requires considerable time and labor to position the curtain wall anchors and weld them in place. The welding also requires costly skilled laborers and adds significantly to the overall construction schedule.

Occasionally embedded anchor channels are specified for a building slab edge to allow for curtain wall attachment. These typically require cutting the steel pour stop and welding sections of anchor channels or block-outs for top mounted anchor channels in the concrete slab. Although these options allow for some adjustability for the curtain wall installation they still do not account for the wavy bent plate slab edge and they require significant coordination between construction trades in addition to being costly to install.

One of the concerns in using existing anchor channels welded to steel edge angles is that excessive loads can cause the edge angle to bend. Structural engineers are regularly confronted with this issue and by contractors who want easier/faster construction techniques. The disclosed curtain wall anchor system embodiments include options for providing a direct or indirect load path into the concrete slab or steel beam to prevent edge angle bending and provide faster, less costly construction.

SUMMARY

This summary is provided to introduce a selection of concepts in a simplified form that are further described below in the Detailed Description. This summary is not intended to identify key factors or essential features of the claimed subject matter, nor is it intended to be used as an aid in determining the scope of the claimed subject matter.

In various embodiments, methods and systems for curtain wall anchors are provided. In particular, various curtain wall anchor systems are described herein to streamline the process of placing curtain walls and to reduce labor time and cost associated with installation of curtain walls.

In a first embodiment, an anchor assembly is provided. The anchor assembly comprises an outwardly extending horizontal flange member configured for engagement with at least a portion of a building support member, such as an I-beam, and an anchor channel configured for engagement with at least a portion of a curtain wall assembly, wherein the anchor channel is disposed opposite the horizontal flange member.

A second embodiment of an anchor assembly comprises an outwardly extending horizontally oriented flange configured for engagement with at least a portion of a building support member such as an I-beam; a first vertically extending flange configured for engagement with at least a portion of a curtain wall assembly; and a second vertically extending flange for engagement with a reinforcing member encased in the concrete slab wherein the first and second vertically oriented flanges are separated by a gap.

In yet another embodiment, a method of installing a curtain wall anchor assembly is provided. The claim recites, providing a curtain wall anchor assembly, wherein the curtain wall anchor assembly includes a pour stop anchor comprising: an anchor channel extending a length of the pour stop anchor, wherein the anchor channel is configured for engagement with at least a portion of a curtain wall bracket; a posterior straight edge located on an opposite side of the anchor channel; and a posterior flange for engagement with at least a portion of a building structure; applying a concrete support slab subsequent to placement of the pour stop anchor assembly; and attaching a curtain wall attachment fitting to the anchor channel of the pour stop anchor assembly.

Further embodiments and aspects will become apparent by reference to the drawings and by study of the following detailed description.

BRIEF DESCRIPTION OF THE DRAWINGS

Illustrative embodiments of the present invention are described in detail below with reference to the attached figures, which are incorporated by reference herein and wherein.

DETAILED DESCRIPTION

Figure 1:
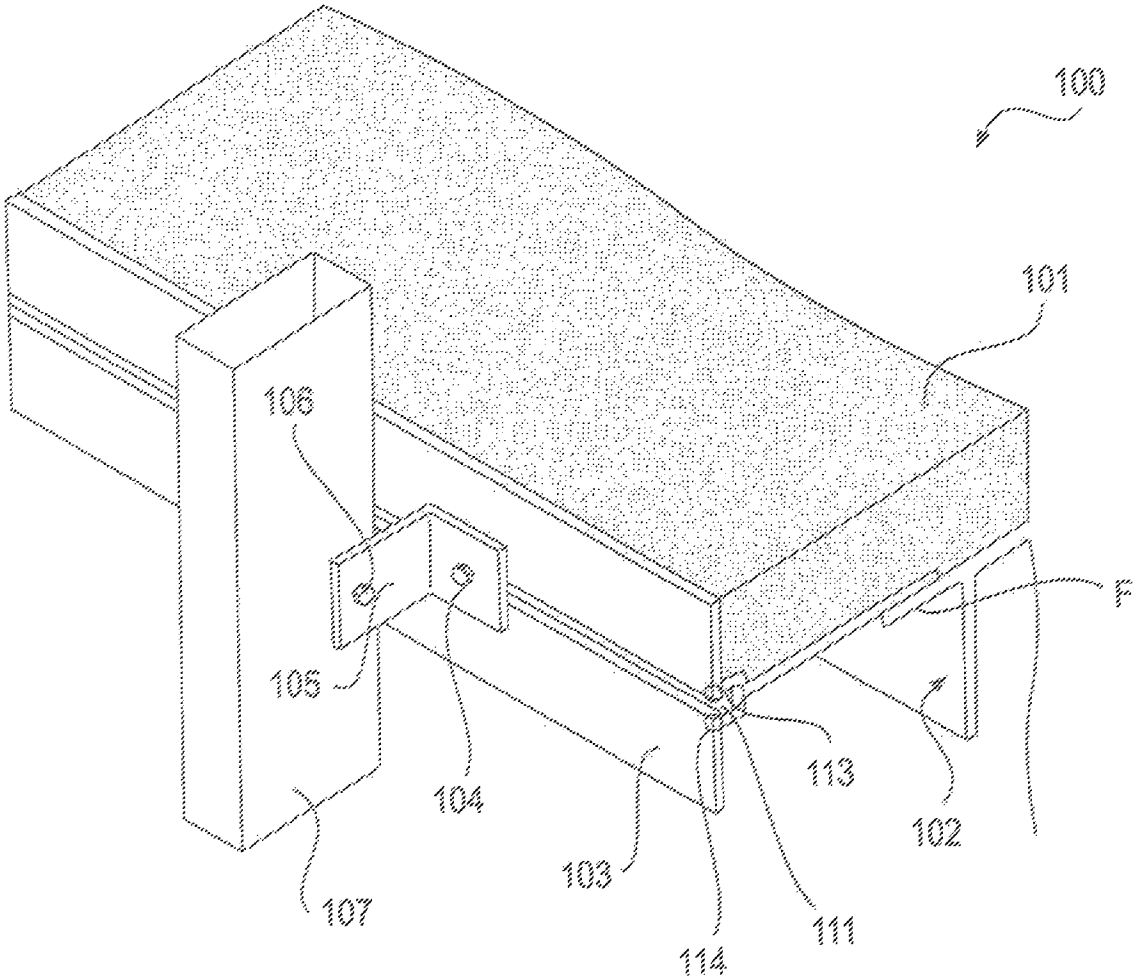
FIG. 1 depicts a perspective view of an embodiment of a curtain wall anchor system.

In the following detailed description, reference is made to the accompanying drawings, which form a part hereof and illustrate exemplary embodiments of the invention. In the drawings, reference numerals describe substantially similar components throughout the several views. These embodiments are described in sufficient detail to enable those skilled in the art to practice the inventions, and it is to be understood that other embodiments may be utilized, and that structural, logical, and procedural changes may be made.

Various embodiments of a curtain wall anchor system are illustrated in FIGS. 1-5. FIG. 1 depicts a curtain wall anchor system 100 and a pour stop 103. Pour stops are used in the construction industry to provide a barrier when pouring concrete. The embodiment depicted in this figure is directed to a pour stop with an integral anchor extrusion. This configuration of a curtain wall anchor provides a means for anchoring a building curtain wall to a structural concrete floor slab and also forming an integral concrete pour stop. As illustrated, the curtain wall anchor system 100 may be positioned adjacent to, and preferably overlapping, a flange "F" of a structural steel support member 102. The curtain wall anchor 100 is preferably welded to the flange F of the structural steel support member 102. Once in place, the pour stop 103 of the curtain wall anchor system 100 provides a barrier to contain the spread of the poured concrete slab 101.

As further depicted in FIG. 1, an anchor bolt 104 is used to secure a curtain wall bracket 105 to the anchor channel 111. An additional bolt 106 may further secure the curtain wall bracket 105 to a curtain wall assembly 107. Various types of anchor bolts 104 may be used. In a preferred embodiment, T-bolts are used. A T-bolt refers generally to a type of bolt having a crosspiece for a head or a bolt with a square head or rectangular shape intended to fit into the anchor channel 111 with the "T" part of the head rotated and securing the bolt in the channel. FIG. 1 illustrates the use of the pour stop 103 with curtain wall installation.

Figure 2:
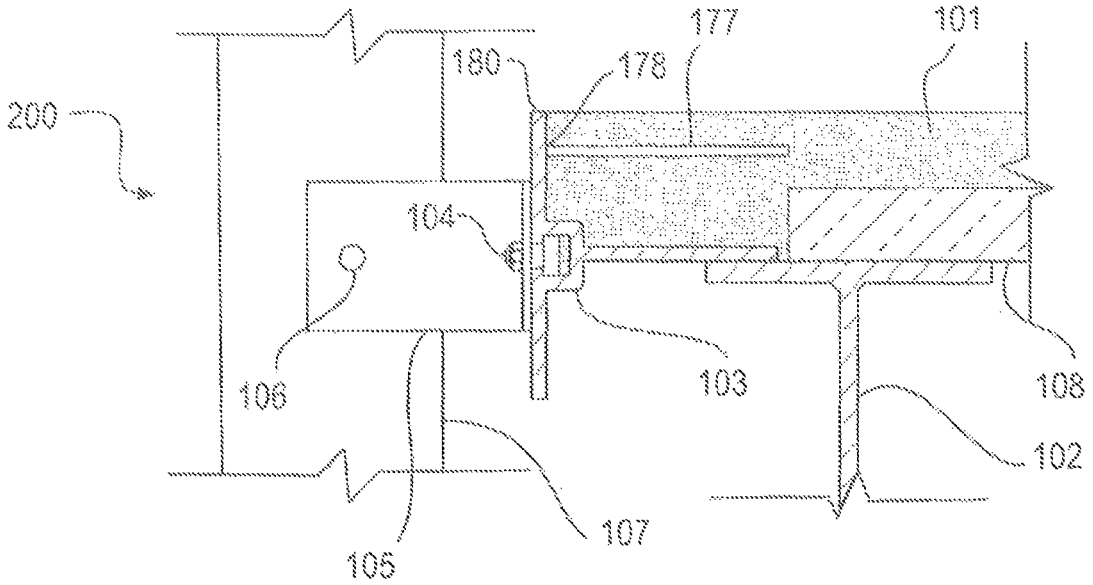
FIG. 2 depicts an elevation view of an embodiment of a curtain wall anchor system.
Figure 3:
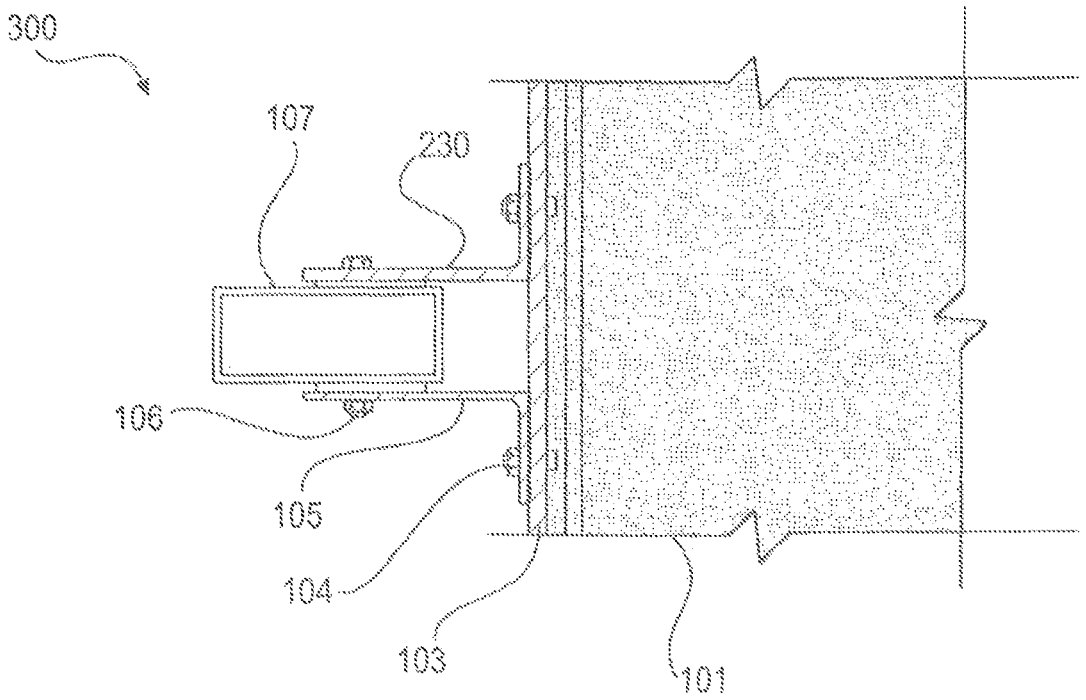
FIG. 3 depicts a plan view of an embodiment of a curtain wall anchor system.

FIG. 2 details an elevation view of the curtain wall anchor system 100 (illustrated in FIG. 1) and details the utilization of reinforcing bar 177 embedded into the concrete slab 101. The reinforcing bar extends to and is connected to the inside face 178 of the upper vertical flange 180. The reinforcing bar 177 serves to develop loads into the concrete slab 101. In practice a plurality of rebar will be embedded into the concrete slab for engagement with the upper vertical flange 180. FIG. 3 provides a plan view of the curtain wall bracket 105 to include a second curtain wall bracket 230 on the opposite side of the curtain wall assembly 107 secured to the pour stop 103.

Figure 4:
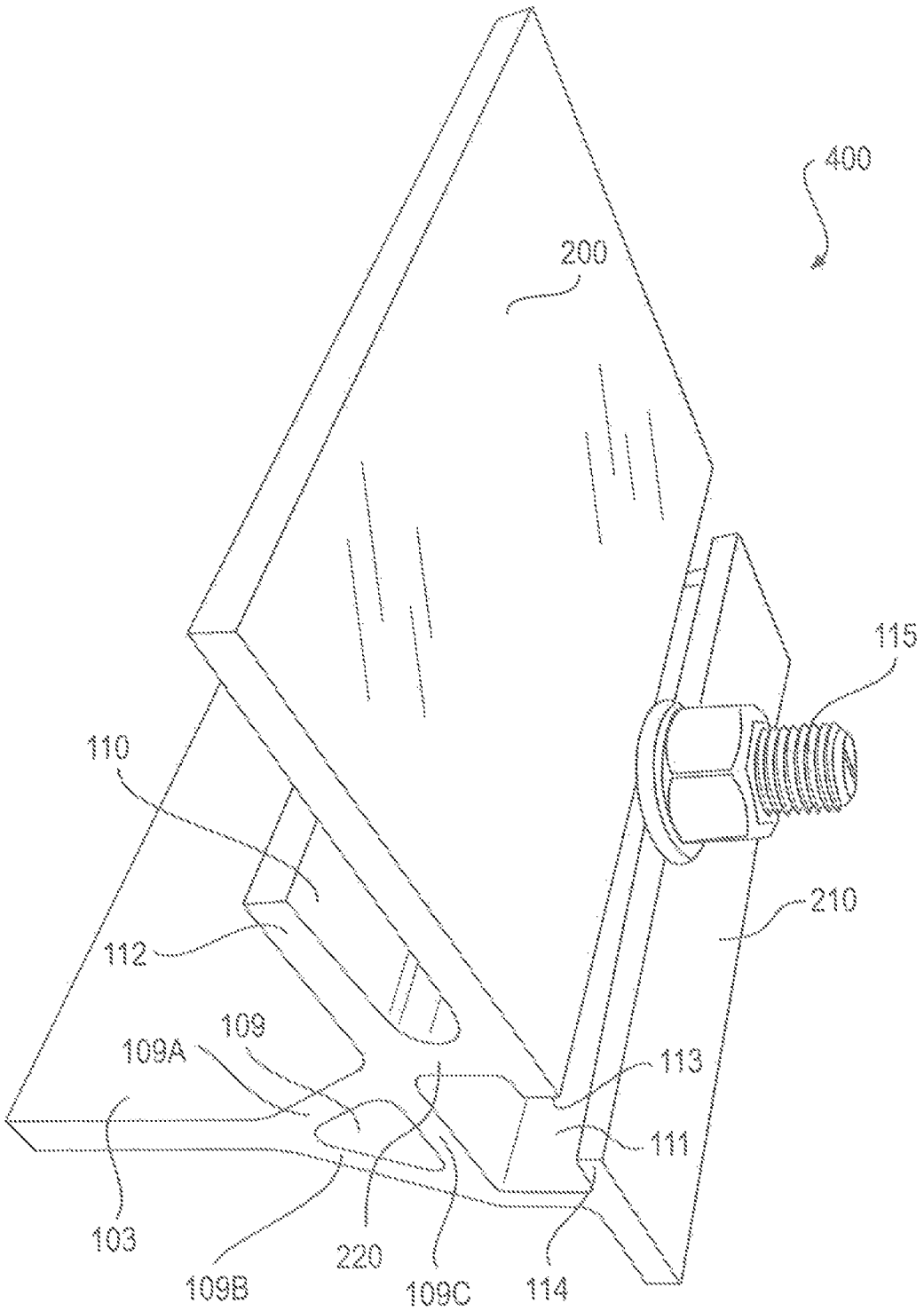
FIG. 4 depicts a perspective view of an embodiment of a curtain wall anchor.

FIG. 4 details an alternative embodiment of a curtain wall anchor apparatus 400 and pour stop or upper vertical flange 200. The anchor apparatus 400 is preferably constructed of steel to facilitate welding; however, other structurally rigid materials may be also be utilized with this disclosed technology. This embodiment of a curtain wall anchor includes a first aperture 109, a slot 110, a lower vertical flange 112, an anchor channel 111, an upper channel flange 113, and a lower channel flange 114. In application, the anchor apparatus 400 may be secured in place via welding to the structural steel support member 102, as shown in FIG. 5.

Figure 5:
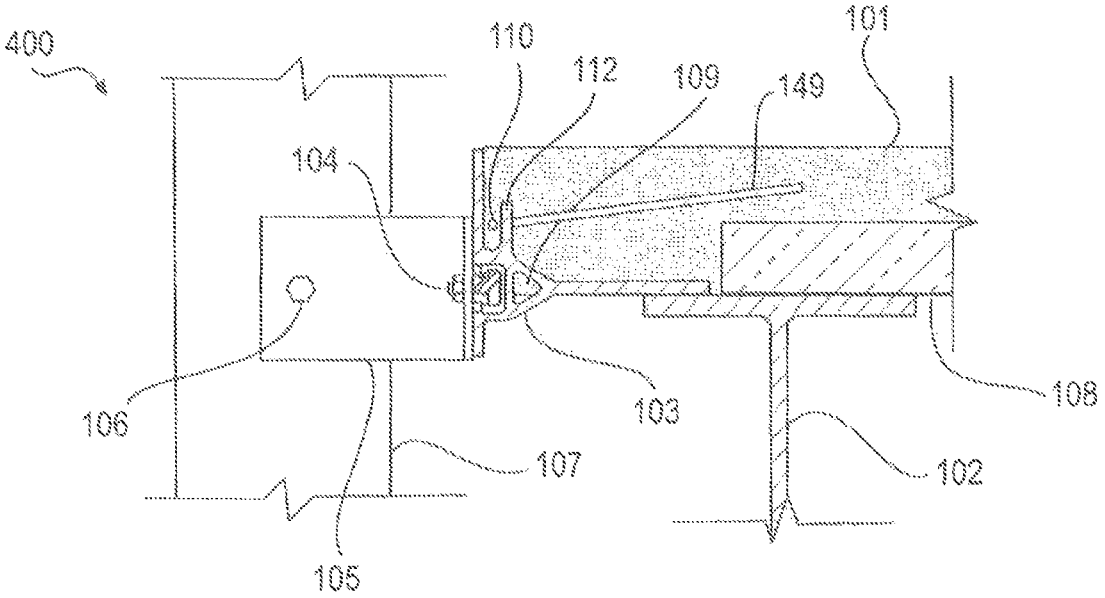
FIG. 5 depicts an elevation view of an embodiment of a curtain wall anchor system.

As further depicted in FIG. 4, the anchor channel 111 is utilized to slidably secure a curtain wall bracket, as seen in FIG. 5 at 105, to the curtain wall assembly 107. The anchor channel 111 is a void space forming a continuous slot along an outside edge of the anchor apparatus 400 to allow a keyed anchor block with a threaded bolt 115 to be attached thereto. As with the first embodiment, illustrated in FIGS. 1 and 2, the bolt 115 is slidably translatable within the anchor channel 111. The anchor channel 111 includes an upper channel flange 113 and a lower channel flange 114 to limit the bolt 115 to slidable longitudinal translation. This ensures that the bolt 115 can slide within the anchor channel 111, until tightened into position, but cannot be extracted perpendicular to the anchor channel 111.

The anchor channel 111 is positioned between a larger upper vertical flange 200 and a descending flange 210. The upper vertical flange 200 transitions to a web member 220 that connects the upper vertical flange 200 to the lower vertical wall member 112. Additionally, the anchor assembly 400 may include a first aperture 109. The first aperture 109 is preferably in the shape of a triangle. The aperture 109 of the optional triangular design reduces the amount of material used in the fabrication of the anchor 400 yet the triangular design utilizes strut members 109A, 109B, and 109C to brace the loads on the extruded anchor 400.

FIG. 5 details an elevation view of the curtain wall anchor system, shown in FIG. 4, with the pour stop 103 and first aperture 109. Also illustrated in FIG. 5 is the slot 110 and lower vertical wall member 112 that optionally is available to secure the pour stop 103. In operation, the rebar 149 passes through a slot (not shown) in the upper edge of the lower vertical wall member 112. A short section of the rebar 149 is then bent at a 90 degree angle and sits inside of the slot 110 running parallel to the lower vertical wall member 112. When curtain wall loads are sufficiently high this short section of rebar 149, when covered with concrete in the slab 101, serves to provide additional load bearing capacity. Multiple rebar 149 rods will preferably be used along the length of the curtain wall anchor system and positioned with the curtain wall anchor apparatus 400 as noted immediately above.

It will be clear from the embodiments described above that the need for an edge angle has been eliminated due to the functionality of the pour stop 103. Additionally, the pour stop provides for an adjustable anchor attachment since the anchor may be moved along the anchor channel 111 as desired.

In each of the embodiments of FIGS. 1-5, installation of the curtain wall will be quicker and less costly by eliminating positioning and welding of the curtain wall clip anchors to traditionally used edge angel pour stops. The designs make horizontal adjustment of curtain wall anchors quicker and simpler than with previous installation techniques. The disclosed designs also facilitate a uniform straight edge of the building slab edge for the installation of exterior walls. These designs thereby reduce the need for thicker steel edge angles required by structural designers for supporting eccentric curtain wall loads. Lastly, this design eliminates the need for studs or reinforcing welds to traditional edge angles to transfer eccentric loads from the curtain wall into the concrete slab.

In each of the described embodiments, where applicable, anchor channels may be customized to accommodate a variety of curtain wall attachment fittings and/or bolts.

Additionally, each anchor assembly described herein may be made of steel or any other material that can sufficiently sustain the load associated with the particular situation. For example, a load for a construction project of a 15-story building will certainly differ from the load to withstand in a construction project of a 2-story building.

While the preferred form of the present invention has been shown and described above, it should be apparent to those skilled in the art that the subject invention is not limited by the figures and that the scope of the invention includes modifications, variations, and equivalents which fall within the scope of the attached claims. Moreover, it should be understood that the individual components of the invention include equivalent embodiments without departing from the spirit of this invention.

It will be understood by those of ordinary skill in the art that the order of the steps recited herein is not meant to limit the scope of the present invention in any way and, in fact, the steps may occur in a variety of different sequences within embodiments hereof. Any and all such variations, and any combinations thereof, are contemplated to be within the scope of embodiments of the present invention.

The invention claimed is:

1. A pour stop with an integral anchor, the pour stop anchor comprising:

an upper vertical wall member separated from a lower vertical wall member by a slot; wherein a reinforcing member passes into the slot and a hook member at a first end of the reinforcing member retains the reinforcing member in position preventing slippage out of the slot, the reinforcing member and the lower vertical wall member embedded within a concrete slab a descending flange and the upper vertical wall member separated by an anchor channel with a rear wall, the anchor channel integral with and extending the full length of the pour stop anchor; wherein, in a use configuration:

the anchor channel is configured for engagement with at least a portion of a curtain wall bracket; and a flange member extends substantially horizontally outwardly from the rear wall of the anchor channel for engagement with a building structural member.

2. The pour stop anchor of claim 1, wherein the flange member extending horizontally outwardly from the rear wall of the anchor channel has a first end disposed adjacent the anchor channel and a second end opposite the first end.

3. The pour stop anchor of claim 2, wherein in a use configuration, the second end of the flange member is disposed atop a structural beam.

4. The pour stop anchor of claim 1, wherein in a use configuration, an upper edge of the upper vertical wall member establishes an upper level of the concrete slab.

5. The pour stop anchor of claim 1, wherein in a use configuration a threaded attachment apparatus disposed within the anchor channel secures a first face of the curtain wall bracket to the pour stop assembly.

6. The pour stop anchor of claim 1 wherein in a use configuration a threaded attachment apparatus secures a second face of the curtain wall bracket to the curtain wall.

7. The pour stop anchor of claim 1, wherein in a use configuration a reinforcing member passes through an opening in the lower vertical wall member and a hook member at a first end of the reinforcing member retains the reinforcing member in position preventing slippage out of the opening, the reinforcing member and the lower vertical wall member are embedded within a concrete slab.

8. A pour stop with an integral anchor, the pour stop with integral anchor comprising:

an integral anchor channel with a rear wall, the anchor channel extending a full length of the pour stop anchor;

a descending flange disposed beneath the anchor channel;

a slot separating an upper vertical wall member and a lower vertical wall member, wherein a base of the lower vertical wall member is comprised of at least one strut member and the rear wall of the anchor channel;

a horizontally extending flange for engagement in a use configuration with a building structure, wherein the horizontally extending flange extends outwardly from a union of a plurality of strut members of the base.

9. The pour stop with an integral anchor of claim 8, wherein in use configuration a second end of the horizontally extending flange member is positioned atop a structural beam.

10. The pour stop with an integral anchor of claim 8, wherein in use configuration the horizontally extending flange member is embedded within a concrete slab.

11. The pour stop with an integral anchor of claim 8, wherein in a use configuration a first threaded attachment apparatus disposed within the anchor channel secures a first face of a curtain wall bracket to the pour stop.

12. The pour stop with an integral anchor of claim 11, wherein a second threaded attachment apparatus secures a second face of the curtain wall bracket to the curtain wall.

13. The pour stop with an integral anchor of claim 8, wherein the lower wall member further comprises an opening for receiving in a use configuration a first end of a reinforcing bar.

14. The pour stop with an integral anchor of claim 13, wherein in a use configuration a second end of the reinforcing bar is embedded within the concrete slab.

15. A pour stop system with an integral anchor for mounting a curtain wall to the exterior structure of a building, the system comprising:

a pour stop anchor with an integral anchor channel, the anchor channel extending a full length of the pour stop anchor, wherein in a use configuration the anchor channel engages with a curtain wall bracket and the anchor channel is disposed beneath an upper vertical wall member;

a flange descending opposite the upper vertical wall member from the anchor channel;

a slot separating the upper vertical wall member and a lower vertical wall member, wherein a base of the lower vertical wall member is comprised of at least one strut member and a rear wall of the anchor channel;

a horizontally extending flange for engagement with a building structure, wherein the horizontally extending flange extends outwardly from a union of a plurality of strut members of the base;

a curtain wall bracket with a first end and a second end;

a curtain wall;

wherein the horizontally extending flange is anchored beneath a concrete slab and the first end of the curtain wall bracket is mounted to the integral anchor channel of the pour stop anchor and the second end of the curtain wall bracket is mounted to the curtain wall thereby providing a path to transfer the load of the curtain wall and wind loads from the curtain wall to the horizontally extending flange.

16. A pour stop system with an integral anchor for mounting a curtain wall to the exterior structure of a building, the pour stop system comprising:

an integral anchor channel further comprising a longitudinally extending opening, a back wall with an inner and an outer surface, an upper and a lower wall, the longitudinally extending opening disposed between longitudinally extending upper and lower face plates, the upper and lower longitudinally extending face plates further comprising an inner and an outer surface, the upper face plate forming a vertical boundary for a concrete slab;

a flange for engagement with a building structural element, the flange extending horizontally outwardly from the outer surface of the back wall and forming a horizontal boundary for the concrete slab;

a curtain wall bracket with a first end and a second end;

in a use configuration, the flange is disposed beneath and partially forms a lower surface of the concrete slab and the first end of the curtain wall bracket is secured to the integral anchor channel of the pour stop and the second end of the curtain wall bracket is mounted to the curtain wall thereby providing a path to transfer a load applied to the curtain wall to the horizontally extending member and ultimately to the building structure.

17. The pour stop system of claim 16, wherein at least one reinforcing bar is secured to the inner surface of the upper face plate and is embedded within the concrete slab.

18. A pour stop with an integral anchor for mounting a curtain wall to the exterior structure of a building, the pour stop comprising:

an integral anchor channel further comprising a longitudinally extending opening, a back wall with an inner and an outer surface, an upper and a lower wall, the longitudinally extending opening disposed between longitudinally extending upper and lower face plates, the upper and lower longitudinally extending face plates further comprising an inner and an outer surface, an upper edge of the upper face plate forming a vertical boundary for a concrete slab;

a flange for engagement with a building structural element, the flange extending horizontally outwardly from the outer surface of the back wall and forming a horizontal boundary for the concrete slab;

a curtain wall bracket with a first end and a second end;

in a use configuration, the flange is disposed beneath and forms a portion of a lower surface of the concrete slab and the first end of the curtain wall bracket is secured to the integral anchor channel of the pour stop and the second end of the curtain wall bracket is mounted to the curtain wall thereby providing a path to transfer a load applied to the curtain wall to the horizontally extending member and ultimately to the building structure.

* * * * *